US012618323B1

(12) United States Patent
Karale et al.

(10) Patent No.: US 12,618,323 B1
(45) Date of Patent: May 5, 2026

(54) INTELLIGENT SCREEN OUT MITIGATION

(71) Applicant: Halliburton Energy Services, Inc., Houston, TX (US)

(72) Inventors: Chaitanya Mallikarajun Karale, Houston, TX (US); Elijah Sterling Bogle, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 26 days.

(21) Appl. No.: 18/935,103

(22) Filed: Nov. 1, 2024

(51) Int. Cl.

| | |
|---|---|
| ***E21B 49/00*** | (2006.01) |
| ***E21B 43/26*** | (2006.01) |
| ***E21B 43/267*** | (2006.01) |
| ***E21B 47/06*** | (2012.01) |
| ***E21B 47/12*** | (2012.01) |

(52) U.S. Cl.
CPC ..... *E21B 49/00* (2013.01); *E21B 43/267* (2013.01); *E21B 47/06* (2013.01)

(58) Field of Classification Search
CPC ..... E21B 47/12; E21B 43/26; E21B 49/00; E21B 47/06; E21B 43/267
See application file for complete search history.

(56) References Cited

U.S. PATENT DOCUMENTS

| | | | |
|---|---|---|---|
| 10,030,473 | B2 | 7/2018 | Tolman et al. |
| 10,787,901 | B2 | 9/2020 | Karale |
| 10,961,835 | B2 | 3/2021 | Mazrooee et al. |
| 11,066,915 | B1 | 7/2021 | Yeung et al. |
| 11,319,790 | B2 | 5/2022 | Potty et al. |
| 2013/0140031 | A1 | 6/2013 | Cohen et al. |
| 2015/0159477 | A1 | 6/2015 | Lecerf et al. |
| 2016/0273346 | A1 | 9/2016 | Tang et al. |
| 2016/0298439 | A1 | 10/2016 | Morrow et al. |
| 2018/0306013 | A1 | 10/2018 | Karale et al. |
| 2019/0323341 | A1 | 10/2019 | Shen et al. |
| 2021/0017853 | A1 | 1/2021 | Iriarte Lopez et al. |
| 2021/0087925 | A1 | 3/2021 | Heidari et al. |
| 2021/0396117 | A1 | 12/2021 | Yeung et al. |

(Continued)

FOREIGN PATENT DOCUMENTS

| | | | | |
|---|---|---|---|---|
| CA | 3062854 | A1 * | 11/2019 | ..... G01V 99/005 |
| WO | 2021061567 | A1 | 4/2021 | |

OTHER PUBLICATIONS

Massaras, et al., Real-time advanced warning of screenouts with the inverse slope method, SPE 150263, 2012.

(Continued)

*Primary Examiner* — Zakiya W Bates
(74) *Attorney, Agent, or Firm* — Michael Jenney; C. Tumey Law Group PLLC

(57) ABSTRACT

Systems and methods may be configured for acquiring one or more pumping operation measurements at a surface during a fracturing operation; calculating a least resistance condition for the fracturing operation based at least in part on the fracturing operation and the one or more pumping operation measurements. In addition, systems and methods may also be configured for calculating a new resistance condition based at least in part on one or more pumping operation measurements and the least resistance condition, and calculating a relative screen out risk with the least resistance condition and the new resistance condition.

20 Claims, 6 Drawing Sheets

(56) References Cited

U.S. PATENT DOCUMENTS

| | | | |
|---|---|---|---|
| 2022/0025753 | A1 | 1/2022 | Heidari et al. |
| 2022/0027538 | A1 | 1/2022 | Walters et al. |
| 2022/0082004 | A1 | 3/2022 | Bannikov et al. |
| 2023/0066612 | A1 | 3/2023 | Parsegov et al. |
| 2023/0086213 | A1 | 3/2023 | Yeung et al. |
| 2023/0383639 | A1 | 11/2023 | Sridhar et al. |

OTHER PUBLICATIONS

Cai, et al., Natural Gas Eng., vol. 2, No. 1, Jun. 2017, Semi Analytical Model for Predicting Screenout in Hydraulic Fracturing in Vertical Wells.

International Search Report and Written Opinion for International Patent Application No. PCT/US2024/055752 dated Jul. 24, 2025. PDF file. 6 pages.

* cited by examiner

INTELLIGENT SCREEN OUT MITIGATION

BACKGROUND

The oil and gas industry may use boreholes as fluid conduits to access subterranean deposits of various fluids and minerals which may include hydrocarbons. A drilling operation may be utilized to construct the fluid conduits which are capable of producing hydrocarbons disposed in subterranean formations. Boreholes may be incrementally constructed as tapered sections, which sequentially extend into a subterranean formation.

In some environments, subterranean deposits are dispersed in shale formations. In such environments, a fracturing operation may be utilized to extract hydrocarbons from the subterranean deposits. Fracturing may depend on the use of fracturing fluids to create fractures, keep the fractures open, and collect the hydrocarbons in the shale formation. One or more pumps ma be used to move the fracturing fluid in and out of the borehole.

Fracturing fluids may also comprise mixtures and other materials to be employed in a fracturing, production, and other downhole operations. In examples, proppant is one mixture or other material employed in downhole operations. The proppant particulates may help prevent the fractures from fully closing upon the release of the hydraulic pressure, forming conductive channels through which fluids may flow to a well bore. During hydraulic fracturing operation, a phenomenon called screen out can occur when a fluid path is blocked by materials such as proppant, sand etc. leading to the increased resistance to the fluid flow, which can happen near the wellbore or perforation holes 108 or far from the wellbore. The screen out may result in inability to pump fluid in the well within given operating limits.

A well that is not producing as expected may be stimulated to increase the production of subsurface hydrocarbon deposits, such as oil and natural gas. Hydraulic fracturing is a type of stimulation treatment that has long been used for well stimulation in unconventional reservoirs. A stimulation treatment operation may involve drilling a horizontal wellbore and injecting treatment fluid into a surrounding formation in multiple stages via a series of perforation holes 108 or formation entry points along a path of a wellbore through the formation. During each stimulation treatment, different types of fracturing fluids, proppant materials (e.g., sand), additives and/or other materials may be pumped into the formation via the entry points or perforation holes 108 at high pressures and/or rates to initiate and propagate fractures within the formation to a desired extent.

During a screen out, a sufficiently high concentration of proppant within one or more perforation holes 108 and/or fractures may plug the fracture and stop the fracturing process. A plugged wellbore causes the pressure of the pumps to exceed the design limits of the fracturing system, putting strain on equipment and creating a risk of damage and other hazards. When a screen out occurs, it may be necessary to discontinue pumping into the well bore to prevent damaging equipment (e.g., the wellhead, casing, etc.) of the fracturing system.

Currently, surface treating pressure may be monitored by personnel on the field or by automated algorithms to detect onset of screen outs. Onset of screen outs can be defined as increase in surface treating pressure when all the controlled variables on the surface e.g. Slurry Rate, Surface proppant concentrations, Friction reducer concentrations are constant. In certain cases, the treatment pressure may rise gradually. Alternatively in certain cases the surface treating pressure may rise gradually beyond the onset of screen out. To avoid surface treating pressure reaching maximum pumping pressure limit, also known as equipment's kickout pressure numerous decisions will be made and executions actions are followed accordingly. In one example a decision can be made to decrease the injection rate or increase the Friction Reducer concentration to decrease the wellbore frictional pressure contribution in order to reduce the surface treating pressure. Alternatively in examples, the treatment pressure may rise rapidly from the onset of screen out and may be immediate attention resulting in quick decisions and actions. In such cases in order to avoid complete screen out a decision can be made to reduce or adjust the slurry proppant concentration to zero to lower value flush the proppant out of the wellbore or near wellbore area to avoid complete shutdown.

BRIEF DESCRIPTION OF DRAWINGS

These drawings illustrate certain aspects of some examples of the present disclosure and should not be used to limit the disclosure.

DETAILED DESCRIPTION

Methods and systems herein may utilize relative resistance approach to estimate the risk of screen out by evaluating the deviation from the minimum resistance situation and recommends adjustments to proppant concentration to avoid screen out. The relative resistance approach estimates the relative risk of a screen out during pumping in hydraulic fracturing.

A relative resistance approach may utilize one or more parameters comprising a minimal resistance. A relative resistance approach may assign the minimal resistance to be the situation or time point where ratio of surface or bottomhole pressure to injection rate is minimal. Most of the perforation holes 108 at this situation are assumed or expected to be open. In an example, at minimal resistance situation where 100% perforation holes 108 are open downhole, there is zero risk.

The least resistance time point may serve as a reference and is further used to evaluate the number of holes open at any time point. The ratio of number of holes open at any time point relative to that at minimum/least resistance situation/timepoint gives the value of 'Relative Resistance' or 'Relative holes open'. Similar to relative resistance estimated using surface treating pressure or bottomhole pressure; a threshold relative resistance can be calculated using minimum/least slurry rate for proppant suspension and kickout pressure. A relative risk can further be estimated by comparing relative resistance to threshold relative resistance. The algorithm may further recommend the control action for proppant concentration adjustment by making use of maximum tolerable risk value or 'Threshold cutoff' based on the relative risk.

Figure 1A:
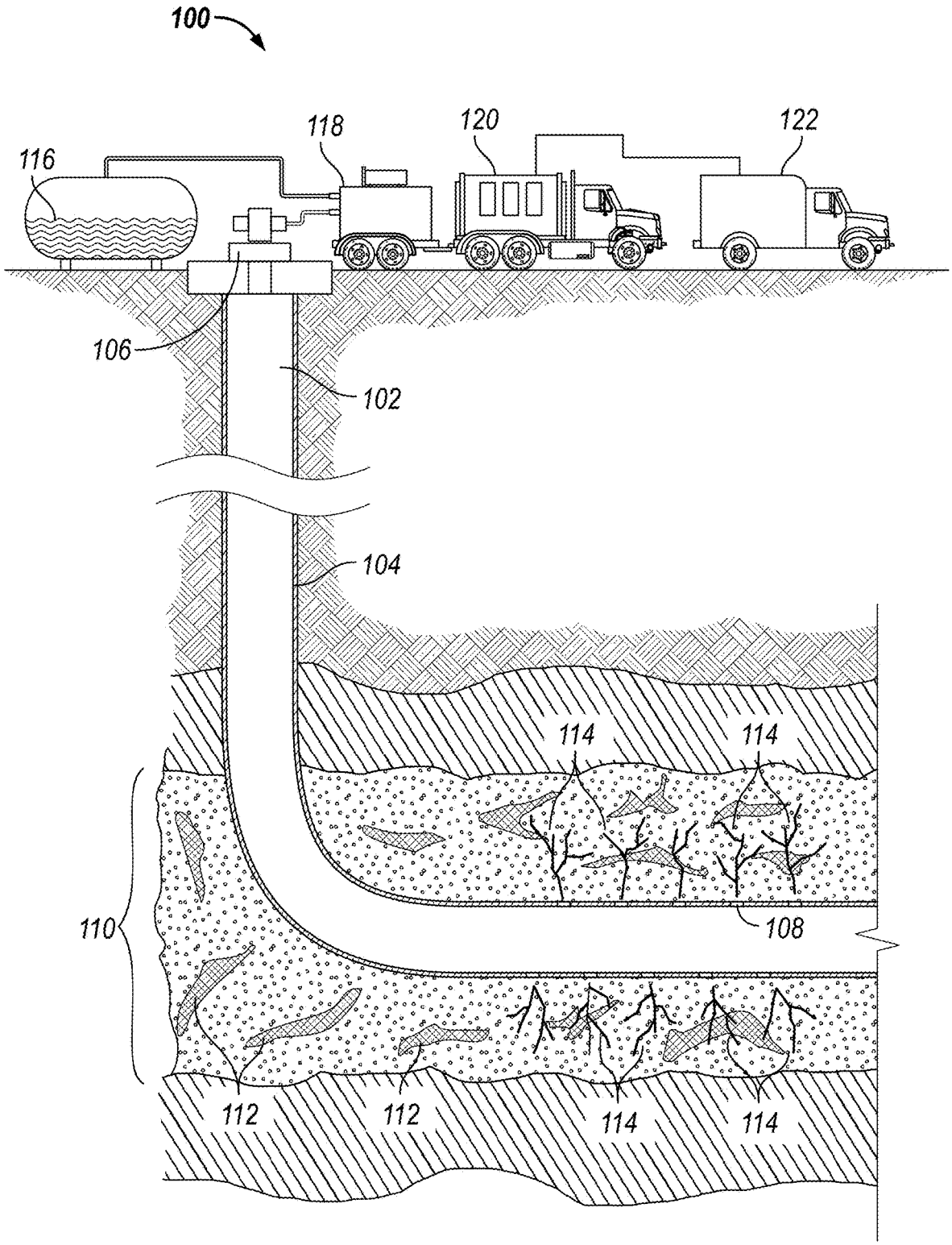
FIG. 1A is a diagram of an example fracturing environment.

FIG. 1A is a diagram of an example fracturing environment. Fracturing operation 100 may include one or more pump(s) 118 (controlled by one or more pump controller 120) that from shale formation 110 via fracture(s) 114. Each of these components is described below.

Borehole 102 is a hole in the ground which may be formed by a drill string (and one or more components thereof) to access subterranean resource deposits. Borehole 102 may be partially or fully lined with casing 104. Further, wellhead 106 may be installed between the surface and borehole 102 to provide control and separation of the contents of borehole 102.

Casing 104 is concrete and/or metal lining that separates borehole 102 from the surrounding ground. Casing 104 may be used to protect the surrounding ground from the contents of borehole 102, and conversely, to protect borehole 102 from the surrounding ground. In fracturing operation 100, casing 104 may be constructed to withstand pressures greater than casings 104 installed in a drilling environment.

Wellhead 106 is a machine which may include one or more pipes, caps, and/or valves to provide pressure control for contents within borehole 102. In any embodiment, wellhead 106 may be equipped with a blowout preventer (not shown) to prevent the flow of higher-pressure fluids (in borehole 102) from escaping to the surface in an uncontrolled manner. Wellhead 106 may be equipped with other ports and/or sensors to monitor pressures within borehole 102 and/or otherwise facilitate drilling and/or fracturing operations.

Perforation holes 108 are small holes created in casing 104 to allow fracturing fluid 116 to flow into shale formation 110. In any embodiment, perforation holes 108 may be created by a perforating gun (not shown) and/or other machine to puncture the walls of casing 104. Perforation holes 108 may be made in any direction in shale formation 110 that allows for the extraction of hydrocarbons 112.

Shale formation 110 is a sedimentary rock layer which is composed of mud, silt, and clay. Shale formation 110 may be formed when layers of mud and silt are deposited in the earth, oceans, lakes, and/or rivers. Over time, the weight of the overlying sediment compresses the mud and silt, forming shale. Shale formation 110 is often found in layers, with other sedimentary rocks, such as sandstone and limestone. Shale formation 110 is typically thin, ranging from a few inches to a few feet in thickness. However, shale formation 110 may be thicker, with some formations reaching thicknesses of over 1,000 feet. In any embodiment, Shale formation 110 may be a source of hydrocarbons 112.

Hydrocarbons 112 are a resource (e.g., oil and/or natural gas) formed from organic matter within shale formation 110. Hydrocarbons 112 may be dispersed within shale formation 110 and not easily accessible. Consequently, extracting hydrocarbons 112 from shale formation 110 may be achieved via hydraulic fracturing (e.g., through fracture(s) 114 created in shale formation 110).

Fracture(s) 114 is a planar crack in shale formation 110 which is created by pumping fracturing fluid 116 into shale formation 110 at high pressure. Fracture(s) 114 begins at perforation hole(s) 108 (through casing 104 of borehole 102). Fracture(s) 114 may be several hundred feet long and several inches wide. They can also be complex, with multiple branches and extensions.

Fracturing fluid 116 is a mixture of liquid(s) and/or solids which may be pumped through borehole 102 to create fracture(s) 114 and collect hydrocarbons 112. In any embodiment, fracturing fluid 116 is typically a mixture of water, proppant, and chemical additives. Water in fracturing fluid 116 may be used to transmit the pressure to shale formation 110 and create fracture(s) 114. A proppant (e.g., sand, ceramic beads) keeps fracture(s) 114 open after fracturing fluid 116 is withdrawn from borehole 102. Chemical additives may be used to improve the performance of fracturing fluid 116 by reducing friction and preventing loss of viscosity. In any embodiment, fracturing fluid 116 is pumped (i.e., via pump(s) 118) down borehole 102 and through perforation holes 108 of casing 104 into shale formation 110. The pressure created by fracturing fluid 116 exceeds the tensile strength of the rocks in shale formation 110, causing the rocks to split and create fracture(s) 114. Consequently, fracturing fluid 116 is forced into fracture(s) 114, and the proppant keeps fracture(s) 114 open after fracturing fluid 116 is withdrawn.

Pump 118 is a machine that may be used to circulate fracturing fluid 116 from a tank to the interior of borehole 102 (e.g., through one or more port(s) on wellhead 106). Pump 118 may be of any type (e.g., centrifugal, gear, etc.) and powered by any suitable means (e.g., electricity, combustible fuel, etc.). In any embodiment, pump(s) 118 may be connected to pump controller 120 which, in turn, operatively connect to information handling system 122. In such a configuration, information handling system 122 may control pump(s) 118 (e.g., initiate powering off, powering on, throttling, etc.) via pump controller 120. In any embodiment, pump 118 may be mounted and transported on an automotive vehicle (e.g., a truck) for transportation to and from fracturing operation 100. Pumps 118 may be configured into pump system 126 (see description for FIG. 1B).

Pump controller 120 is a hardware computing device that may control one or more pump(s) 118. In any embodiment, pump controller 120 may control the flow of electrical power (e.g., voltage, current) to pump(s) 118 and/or control the flow of fuel (e.g., via a choke, any valve) to pump(s) 118. In turn, pump controller 120 may control the rotational speed, torque, power, torque, and/or flow rate of pump(s) 118. In addition, pump controller 120 may provide real-time surface pressure measurements. Herein, surface pressure may be defined as pressure at wellhead 106. Herein, a pumping operation may be referred to as pumping proppant into a formation within the process of fracturing operation 100. In examples, wellhead 106 may comprise one or more pressure gauges configured to provide pressure at the wellhead in real time. In other examples, the pressure may be taken at any location on the surface. In addition to pressure measurements, flow rate, surface proppant concentration, bottomhole pressure, friction reducer concentration, slurry density, etc., and/or the like may all be collected in real-time and referred to as pumping operation measurements. Herein, real time may be defined as measurements taken and processed by information handling system and/or pump controller 120 instantaneously, 0.01 ns-1 ns, 1 ns-1 second, 1 second-1 minute, or longer. Further, pumping operation measurements may be acquired and stored to be accessed at any time. As such, measurements during the whole pumping operation at one time may be utilized in conjunction with measurements acquired at a different time.

Figure 1B:
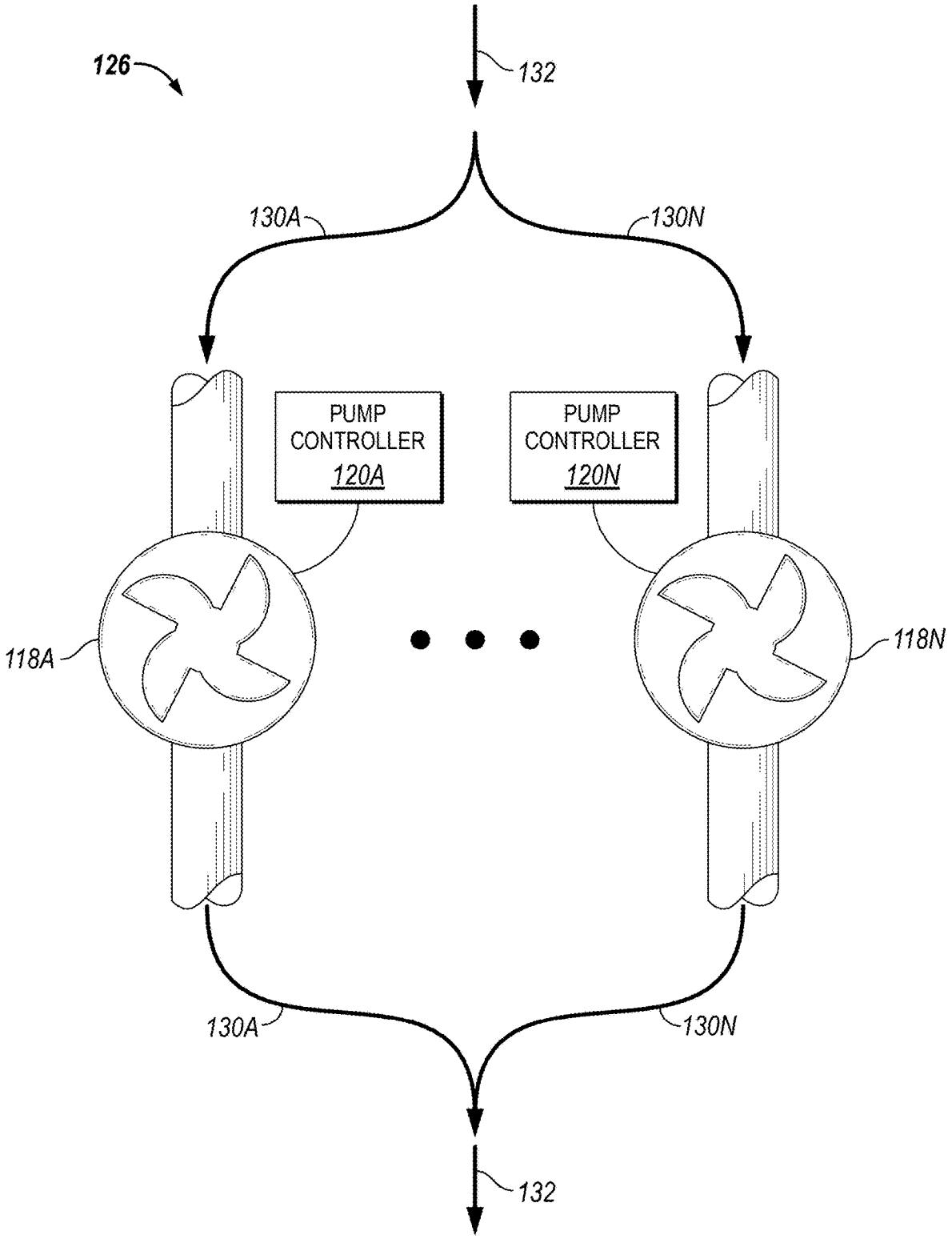
FIG. 1B is a diagram of an example pump system.

Information handling system 122 is a hardware computing device which may be utilized to perform various steps, methods, and techniques disclosed herein (e.g., via the execution of software). In any embodiment, information handling system 122 may include one or more processor(s), cache, memory, storage, and/or one or more peripheral device(s). Any two or more of these components may be operatively connected via a system bus that provides a means for transferring data between those components. Information handling system 122 may be operatively connected to pump controller 120 (and/or other various components of fracturing operation 100). In any embodiment, information handling system 122 may utilize any suitable form of wired and/or wireless communication to send and/or receive data to and/or from other components of fracturing operation 100 (e.g., to control one or more pump(s) 118 via pump controller 120). In any embodiment, information handling system 122 may receive a digital telemetry signal, demodulate the signal, display data (e.g., via a visual output device), and/or store the data. Additional details regarding information handling system 122 may be found in the description of FIG. 1A. Further, FIG. 1B is a diagram of an example pump system. Pump system 126 may include one or more pump(s) 118, each with a respective flow rates 130A and/or flow rate 130N.

In pump system 126, two or more pumps 118 may be configured into a "parallel" (as shown in FIG. 1B), where two or more pumps 118 pull a fluid from the same source and output that fluid to the same destination. In any embodiment, two or more pumps 118 may be configured into a "series" pump system 126 (not shown) where pumps 118 are attached so that the output from one pump 118 feeds the input of another pump 118. Additionally, in any embodiment, three or more pumps 118 may be configured into a hybrid system where pumps 118 are configured into a combination of a "parallel" and "series" systems (e.g., two pumps in "series" may be configured to operate in "parallel" with at least one other pump, configured in "series").

In any "parallel" pump system 126, pumps 118 may be interchangeable, with pumps 118 going online and offline for varying reasons. As a non-limiting example, in FIG. 1B, pump A 118A is a pump that is designed and configured to operate at flow rate 130A, for the broader system. Further, pump N 118N is pump that sits powered off and idle while pump A 118A is operating. Then, if pump A 118A is powered off (or otherwise fails for any reason), pump N 118N may be powered on to provide the same (or similar) flow rate N 130N as flow rate A 130A (e.g., via pump controller N 120N).

Flow rate 130A and/or flow rate 130N is the volumetric flow rate (e.g., measured in volume per time) of a fluid (e.g., fracturing fluid 116) flowing through a respective pump 118. In any embodiment, flow rate 130A and/or flow rate 130N (for a corresponding pump 118) may be relatively constant when pump 118 is operating at full power. Additionally, flow rate 130A and/or flow rate 130N may be variable by controlling the power provided to pump 118. In any embodiment, when pump 118 is not provided with any power (e.g., is powered off), flow rate 130A and/or flow rate 130N may be at 0 (or approaching 0, if recently powered off). Further, when pump 118 is powering up, flow rate 130A and/or flow rate 130N may increase from 0 to a maximum and/or otherwise controlled flow rate 130A and/or flow rate 130N.

Total flow rate 132 is the combined volumetric flow rate (e.g., measured in volume per unit time) of a fluid (e.g., fracturing fluid 116) flowing through pump system 126. In pump systems 126 with a single pump 118, total flow rate 132 will be equal to the flow rate 130A and/or flow rate 130N associated with single pump 118. In other examples, there may also be a plurality of pump(s) 118. In pump systems 126 with two or more pumps 118, connected in "series", total flow rate 132 will be equal to the flow rate 130A and/or flow rate 130N for any of the individual pumps 118 in the system. In pump systems 126 with two or more pumps 118 configured in "parallel", total flow rate 132 is equal to the sum of the flow rates 130A and/or flow rate 130N for each line of parallel pump(s) 118.

Information handling system 122 is a hardware computing device which may be utilized to perform various steps, methods, and techniques disclosed herein (e.g., via the execution of software). In any embodiment, information handling system 122 may include one or more processor(s) 202, cache 204, memory 206, storage 208, and/or one or more peripheral device(s) 209. Any two or more of these components may be operatively connected via a system bus (not shown) that provides a means for transferring data between those components. Although each component is depicted and disclosed as individual functional components, these individual components may be combined (or divided) into any combination or configuration of components.

A system bus is a system of hardware connections (e.g., sockets, ports, wiring, conductive tracings on a printed circuit board (PCB), etc.) used for sending (and receiving) data to (and from) each of the components connected thereto. In any embodiment, a system bus allows for communication via an interface and protocol (e.g., inter-integrated circuit (I2C), peripheral component interconnect (express) (PCI(e)) fabric, etc.) that may be commonly recognized by the components utilizing the system bus. In any embodiment, a basic input/output system (BIOS) may be configured to transfer information between the components using the system bus (e.g., during initialization of information handling system 122).

Figure 2:
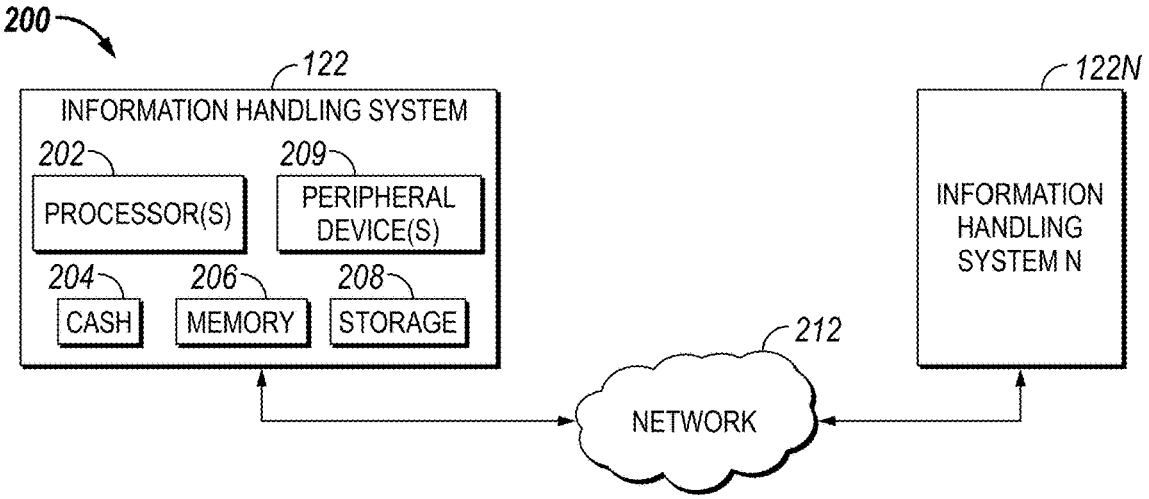
FIG. 2 is a diagram of an example computing environment.

FIG. 2 illustrates communication system 200. In any embodiment, information handling system 122 may additionally include internal physical interface(s) (e.g., serial advanced technology attachment (SATA) ports, peripheral component interconnect (PCI) ports, PCI express (PCIe) ports, next generation form factor (NGFF) ports, M.2 ports, etc.) and/or external physical interface(s) (e.g., universal serial bus (USB) ports, recommended standard (RS) serial ports, audio/visual ports, etc.). Internal physical interface(s) and external physical interface(s) may facilitate the operative connection to one or more peripheral device(s) 209.

Non-limiting examples of information handling system 122 include a general purpose computer (e.g., a personal computer, desktop, laptop, tablet, smart phone, etc.), a network device (e.g., switch, router, multi-layer switch, etc.), a server (e.g., a blade-server in a blade-server chassis, a rack server in a rack, etc.), a controller (e.g., a programmable logic controller (PLC)), and/or any other type of computing device with the aforementioned capabilities. Further, information handling system 122 may be operatively connected to another information handling system 122 via network 212 in a distributed computing environment. As used herein, a "computing device" may be equivalent to an information handling system.

Processor 202 is a hardware device which may take the form of an integrated circuit configured to process computer-executable instructions (e.g., software). Processor 202 may execute (e.g., read and process) computer-executable instructions stored in cache 204, memory 206, and/or storage 208. Processor 202 may be a self-contained computing system, including a system bus, memory, cache, and/or any other components of a computing device. Processor 202 may include multiple processors, such as a system having multiple physically separate processors in different sockets, or a system having multiple processor cores on a single physical chip. A multi-core processor may be symmetric or asymmetric. Multiple processors 202, and/or processor cores thereof, may share resources (e.g., cache 204, memory 206) or may operate using independent resources.

Non-limiting examples of processor 202 include general-purpose processor (e.g., a central processing unit (CPU)), an application specific integrated circuit (ASIC), a programmable gate array (PGA), a field programmable gate array (FPGA), a digital signal processor (DSP), and any digital or analog circuit configured to perform operations based on input data (e.g., execute program instructions).

Cache 204 is one or more hardware device(s) capable of storing digital information (e.g., data) in a non-transitory medium. Cache 204 expressly excludes transitory media (e.g., transitory waves, energy, carrier signals, electromagnetic waves, signals per se, etc.). Cache 204 may be considered "high-speed", having comparatively faster read/write access than memory 206 and storage 208, and therefore utilized by processor 202 to process data more quickly than data stored in memory 206 or storage 208. Accordingly, processor 202 may copy needed data to cache 204 (from memory 206 and/or storage 208) for comparatively speedier access when processing that data. In any embodiment, cache 204 may be included in processor 202 (e.g., as a subcomponent). In any embodiment, cache 204 may be physically independent, but operatively connected to processor 202.

Cache 204 is one or more hardware device(s) capable of storing digital information (e.g., data) in a non-transitory medium. Cache 204 expressly excludes transitory media (e.g., transitory waves, energy, carrier signals, electromagnetic waves, signals per se, etc.). Cache 204 may be considered "high-speed", having comparatively faster read/write access than memory 206 and storage 208, and therefore utilized by processor 202 to process data more quickly than data stored in memory 206 or storage 208. Accordingly, processor 202 may copy data to cache 204 (from memory 206 and/or storage 208) for comparatively speedier access when processing that data. In any embodiment, cache 204 may be included in processor 202 (e.g., as a subcomponent). In any embodiment, cache 204 may be physically independent, but operatively connected to processor 202.

Storage 208 is one or more hardware device(s) capable of storing digital information (e.g., data) in a non-transitory medium. Storage 208 expressly excludes transitory media (e.g., transitory waves, energy, carrier signals, electromagnetic waves, signals per se, etc.). In any embodiment, the smallest unit of data readable from storage 208 may be a "block" (instead of a "byte"). Prior to reading and/or manipulating the data on storage 208, one or more block(s) may be copied to an intermediary storage medium (e.g., cache 204, memory 206) where the data may then be accessed in "bytes" (e.g., via random access). In any embodiment, data on storage 208 may be accessed in "bytes" (like memory 206). Non-limiting examples of storage 208 include integrated circuit storage devices (e.g., a solid-state drive (SSD), Non-Volatile Memory Express (NVMe), flash memory, etc.), magnetic storage devices (e.g., a hard disk drive (HDD), floppy disk, magnetic tape, diskette, cassettes, etc.), optical media (e.g., a compact disc (CD), digital versatile disc (DVD), etc.), and printed media (e.g., barcode, quick response (QR) code, punch card, etc.).

As used herein, "non-transitory computer readable medium" is cache 204, memory 206, storage 208, and/or any other hardware device capable of non-transitorily storing and/or carrying data.

Peripheral device(s) 209 is a hardware device configured to send (and/or receive) data to (and/or from) information handling system 122 via one or more internal and/or external physical interface(s). Any peripheral device(s) 209 may be categorized as one or more "types" of computing devices (e.g., an "input" device, "output" device, "communication" device, etc.). However, such categories are not comprehensive and are not mutually exclusive. Such categories are listed herein strictly to provide understandable groupings of the potential types of peripheral device(s) s 209. As such, peripheral device(s) 209 may be an input device, an output device, a communication device, and/or any other optional computing component.

An input device is a hardware device that receives data into information handling system 122. In any embodiment, an input device may be a human interface device which facilitates user interaction by collecting data based on user inputs (e.g., a mouse, keyboard, camera, microphone, touchpad, touchscreen, fingerprint reader, joystick, gamepad, etc.). In any embodiment, an input device may collect data based on raw inputs, regardless of human interaction (e.g., any sensor, logging tool, audio/video capture card, etc.). In any embodiment, an input device may be a reader for accessing data on a non-transitory computer readable medium (e.g., a CD drive, floppy disk drive, tape drive, scanner, etc.).

An output device is a hardware device that sends data from information handling system 122. In any embodiment, an output device may be a human interface device which facilitates providing data to a user (e.g., a visual display monitor, speakers, printer, status light, haptic feedback device, etc.). In any embodiment, an output device may be a writer for facilitating storage of data on a non-transitory computer readable medium (e.g., a CD drive, floppy disk drive, magnetic tape drive, printer, etc.).

A communication device is a hardware device capable of sending and/or receiving data with one or more other communication device(s) (e.g., connected to another information handling system 122 via network 212). Herein data may comprise real-time pressure measurements. A communication device may communicate via any suitable form of wired interface (e.g., Ethernet, fiber optic, serial communication etc.) and/or wireless interface (e.g., Wi-Fi® (Institute of Electrical and Electronics Engineers (IEEE) 802.11), Bluetooth® (IEEE 802.15.1), etc.) and utilize one or more protocol(s) for the transmission and receipt of data (e.g., transmission control protocol (TCP), user datagram protocol (UDP), internet protocol (IP), remote direct memory access (RDMA), etc.). Non-limiting examples of a communication device include a network interface card (NIC), a modem, an Ethernet card/adapter, and a Wi-Fi® card/adapter.

An optional computing component is any hardware device that operatively connects to information handling system 122 and extends the capabilities of information handling system 122. Non-limiting examples of an optional computing components include a graphics processing unit (GPU), a data processing unit (DPU), and a docking station.

As used herein, "software" (e.g., "code", "algorithm", "application", "routine") is data in the form of computer-executable instructions. Processor 202 may execute (e.g., read and process) software to perform one or more function(s). Non-limiting examples of functions may include reading existing data, modifying existing data, generating new data, and using any capability of information handling system 122 (e.g., reading existing data from memory 206, generating new data from the existing data, sending the generated data to a GPU to be displayed on a monitor). Although software physically persists in cache 204, memory 206, and/or storage 208, one or more software instances may be depicted, in the figures, as an external component of any information handling system 122 that interacts with one or more information handling system(s) 122.

Network 212 is a collection of connected information handling systems (e.g., 122, 122N) that allows for the exchange of data and/or the sharing of computing resources therebetween. Non-limiting examples of network 212 include a local area network (LAN), a wide area network (WAN) (e.g., the Internet), a mobile network, any combination thereof, and any other type of network that allows for the communication of data and sharing of resources among computing devices operatively connected thereto. A person of ordinary skill in the relevant art, having the benefit of this detailed description, would appreciate that a network is a collection of operatively connected computing devices that enables communication between those computing devices. In addition, real-time pressure measurements may be utilized and populated on network 212.

Figure 3A:
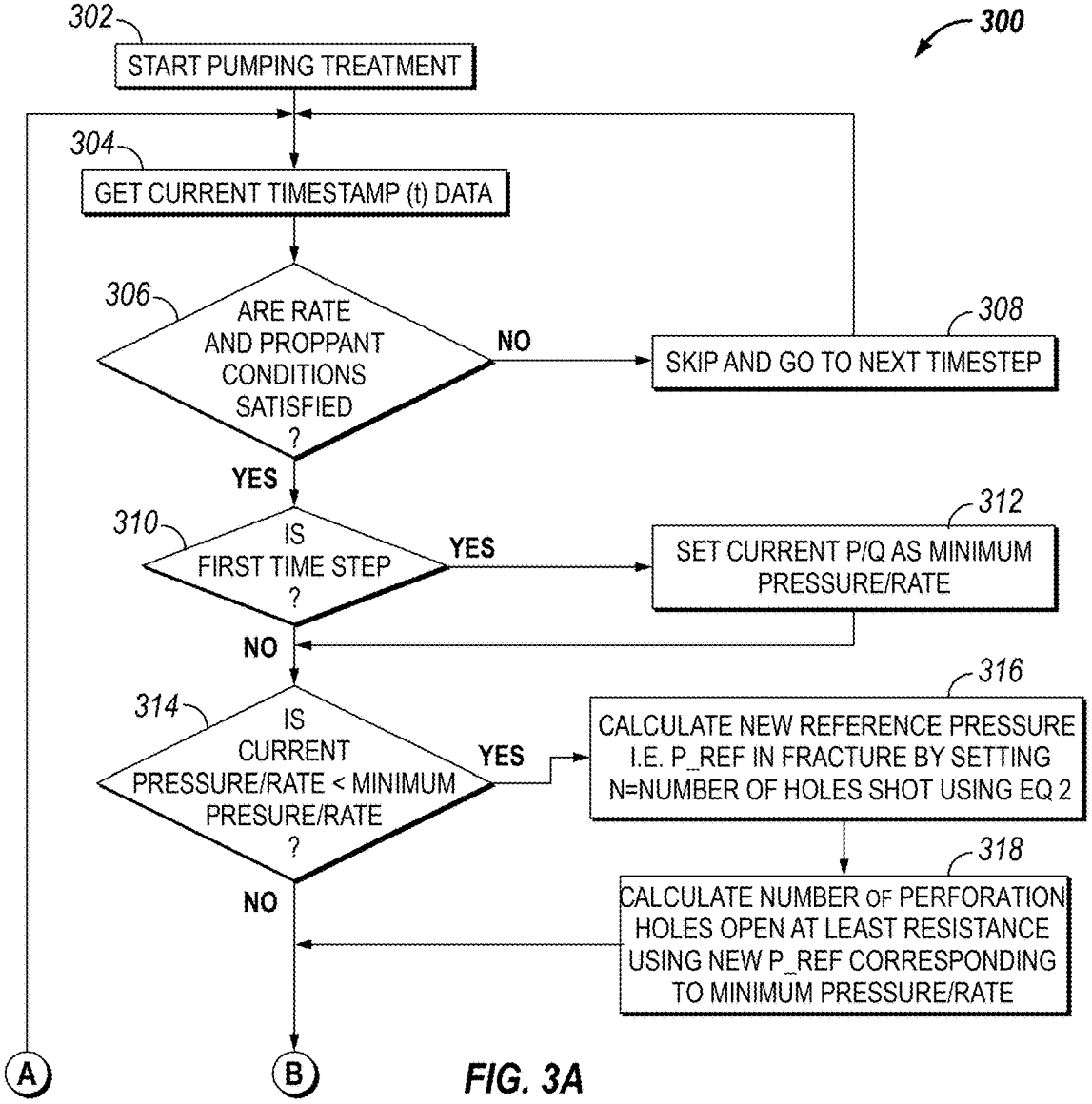
FIG. 3A is the first part of a flowchart for calculating relative risk of a screen out.

FIG. 3A illustrates workflow 300 for calculating relative risk of a screen out. In examples, workflow 300 may be performed on information handling system 122. In block 302, a fracturing operation may begin a pumping treatment after perforation holes 108 are formed within shale formation 110 (e.g., referring to FIG. 1). A fracturing operation may define specific instructions at specific depths and times for every component in the drilling or fracturing operation. In examples, a pumping treatment may comprise pumping proppant into a formation. As discussed above, the proppant may fill perforation holes 108 within shale formation 110. In block 304, information handling system 122 and/or pump controller 120 may obtain current timestamp data. Current timestamp data may comprise the current time, current pump rate of pumps 118, current pressure at the surface and or at bottom of wellbore, Slurry Rate, Slurry proppant concentration, Gel concentration, Friction reducer concentration, and the like. Herein, current timestamp data may be defined as the aforementioned real-time measurements measured at the surface. Current timestamp data may be stored dataset and have corresponding previous timestamps and subsequent later timestamps to be taken in the future, with the exceptions of the first and last timestamps. Each timestamp data may be separated by 0.00001 ns-1 ns, 1 ns-0.001 s,-0.001 s-1 s, 1 s-1 minute, or 1 minute-1 hour. In block 306, if the pump rate of pump 118 is no, not satisfied as per the fracturing operation, workflow 300 may proceed to block 308, otherwise workflow 300 may proceed to block 310.

In block 308, workflow 300 may proceed to block 304, until the pump rate is increased to satisfy the fracturing operation. In block 310, if the current timestamp pressure at the surface and flow rate is the first timestamp, then in block 312 the current timestamp pressure at the surface $P_s$ and current flow rate Q may be used to calculate the current bottomhole pressure BHP as shown in Equation (1):

$$\text{BHP}=P_s+P_f+P_h \qquad \text{Equation (1)}$$

Herein, $P_s$, $P_f$, $P_h$ are Surface treating pressure, Frictional pressure drop and Hydrostatic pressure respectively.

In addition, in block 312, the ratio of current bottomhole pressure BHP divided by current flow rate Q may be defined as minimum pressure flow rate (BHP/Q) min. In examples, P/Q or pressure/Rate may be surface pressure/Q or BHP/Q. If minimum pressure flow rate (BHP/Q) min was previously defined or once it was defined in block 312, then workflow 300 may proceed to block 314. In block 314, if the current timestamp pressure flow rate (BHP/Q) is less than (BHP/Q) min, then workflow 300 may proceed to block 316. In examples, current timestamp pressure flow rate (BHP/Q) may be calculated by dividing current bottomhole pressure BHP by current flow rate Q. In block 316, current bottom hole pressure BHP and current flow rate Q corresponding to this new (BHP/Q) min may be used to calculate a new reference pressure P_ref. Herein, reference pressure P_ref may be the pressure outside of perforation or within fracture. In addition, reference pressure P_ref may be the pressure inside fracture at new least resistance. Then a new reference pressure $P_{ref}$ may be calculated in Equation (2):

$$\text{BHP}-P_{ref}=(0.2369\times\rho\times Q^2)/(Cd^2\times D^4\times N^2) \qquad \text{Equation (2)}$$

Herein, Q is the current flow rate and ρ, Cd, D, N are slurry density, discharge coefficient, perforation diameter, and the number of perforation holes 108 open. At least resistance condition 100% holes are open N therefore takes value of $N_{,0}$. which may be predefined.

In examples, $N_{,0}$ may be the initial number of perforation holes 108 defined as per fracturing operation 100. In examples N may be any value between 0 and N,0 appropriate to the situation which serves as initial reference number of perforation holes 108 open at least resistance situation. In examples, least resistance and minimum resistance may be used interchangeably describing same meaning or purpose. In examples, the number of perforation holes 108 open N may be set as the initial number of perforation holes 108 defined as per fracturing operation 100.

In block 318, the initial number of perforation holes 108 $N_{,0}$ may be calculated with the new reference pressure $P_{ref}$ and minimum flow rate (BHP/Q) min from blocks 316 and 312. Herein, any computation of least resistance may be referred to as a least resistance condition. In addition, any computation of current or a new resistance may be referred to as new resistance condition. Herein, resistance may be referred to as a relative proportion of downhole pressure during fracturing operation 100. In other examples, resistance may be referred to as a relative effect of the number of open hole perforations which are operating as intended during a fracturing operation 100. It may also be correlated to the ability, or lack thereof, for fluids in the well entering the formation through fractures. In block 320, the next or any other timestamp, the reference pressure $P_{ref}$ from block 316 may be used to calculate number of perforation holes 108 open at timestamp $N_{,t}$ i.e. may be computed by using BHP and Q at respective timestamps in Equation (2). Previously, Equation (2) was utilized with an assigned number of perforation holes 108 open N in block 316 to estimate $P_{ref}$.

However, in block 320 the estimated reference pressure P_ref from block 316 may be used to calculate current number of perforation holes 108 open $N_{,t}$ for a given bottom hole pressure BHP and flow rate Q at any timestamp. Herein, conditions computed with timestamp 't' may be used to compute a deviation from the least resistance. As such, Equation (2) may be modified to compute the current time stamp number of perforation holes 108 open N assigned as $N_{,t}$ as shown by Equation 3.

$$N_{,t}=\sqrt{\frac{(0.2369\times\rho\times Q^2)/(BHP-P_{ref})}{Cd^2\times D^4}} \qquad \text{Equation (3)}$$

Figure 4:
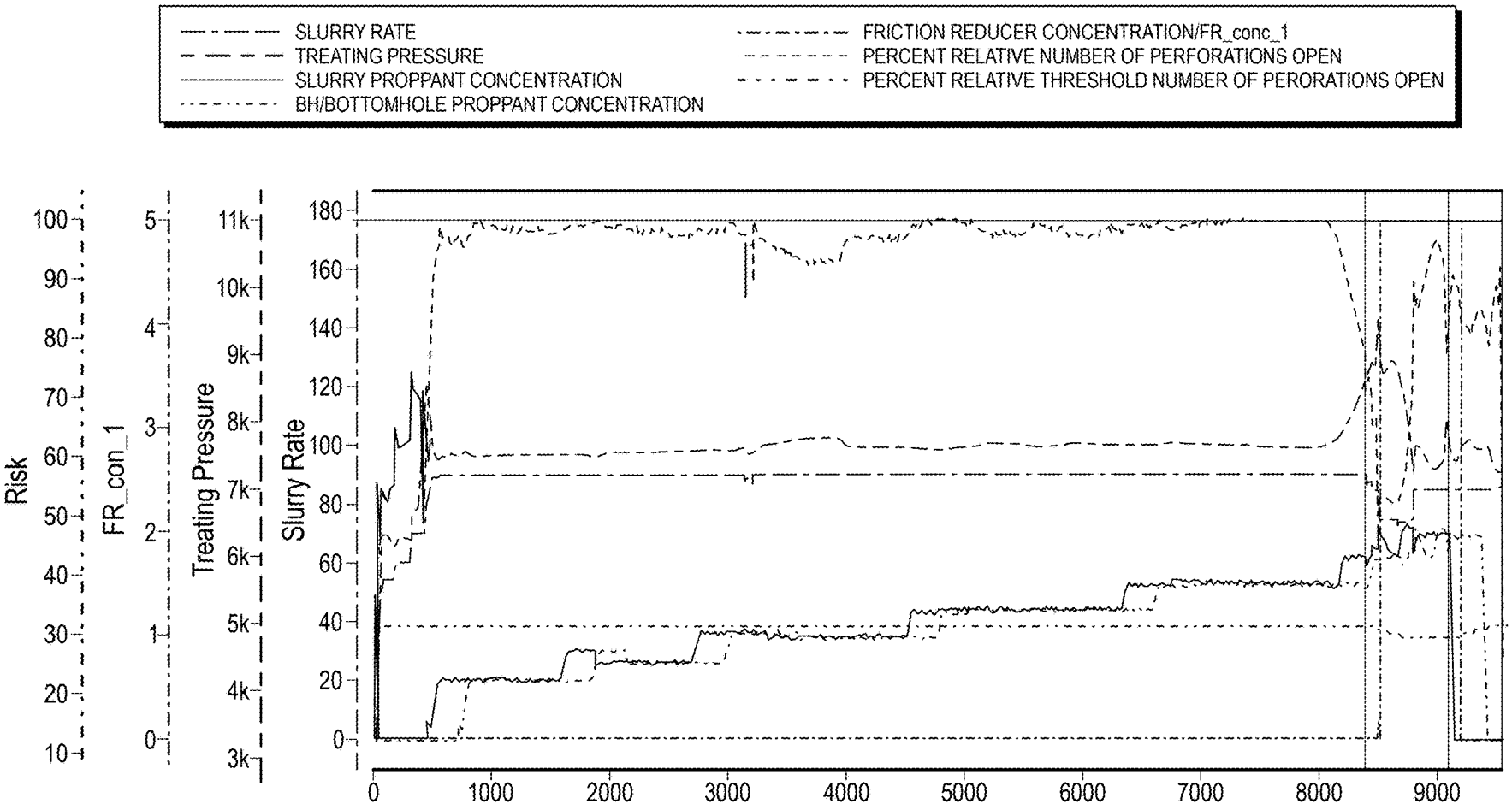
FIG. 4 illustrates curve for percentage relative number of holes open for one of the treatments.

In block 322, relative number of perforation holes 108 open at time t i.e. relative $N_{,t}$ may be computed by Equation (4):

$$\text{relative } N_{,t} = \frac{N_{,t}}{N_{,0}} \quad \text{Equation (4)}$$

Where $N_{,t}$ was the calculated number of any timestamp perforation holes 108 from block 320 and $N_{,0}$ may be the initial number of perforation holes 108 defined as per fracturing operation 100 or the number of perforation holes 108 at least resistance. FIG. 4 illustrates curve for percentage relative number of perforation holes 108 open for one of the treatments which is calculated as Percentage Relative $N_{,t}=100*N_{,t}/N_{,0}$. Alternatively the ratio of number of perforation holes 108 open at any time point relative to that at minimum resistance situation/timepoint gives the value of 'Relative Resistance' or 'Relative perforation holes 108 open'.

Referring back to workflow 300, in block 324, similarly, Using kickout pressure value in place for surface treating pressure for BHP estimation and minimum slurry rate for frictional pressure drop in Equation (1) and minimum slurry rate in Equation (2) and with $P_{ref}$ from previous least resistance situation i.e. from block 316, a threshold perforation holes 108 open may be calculated. As such, Equation (2) may be modified to compute current time stamp threshold number of perforation holes 108 open $N_{Threshold,t}$. For example, Equation (2) may be modified to Equation (5):

$$N_{Threshold,t} = \sqrt{\frac{(0.2369 \times \rho \times Q^2)/(BHP - P_{ref})}{Cd^2 \times D^4}} \quad \text{Equation (5)}$$

Figure 5:
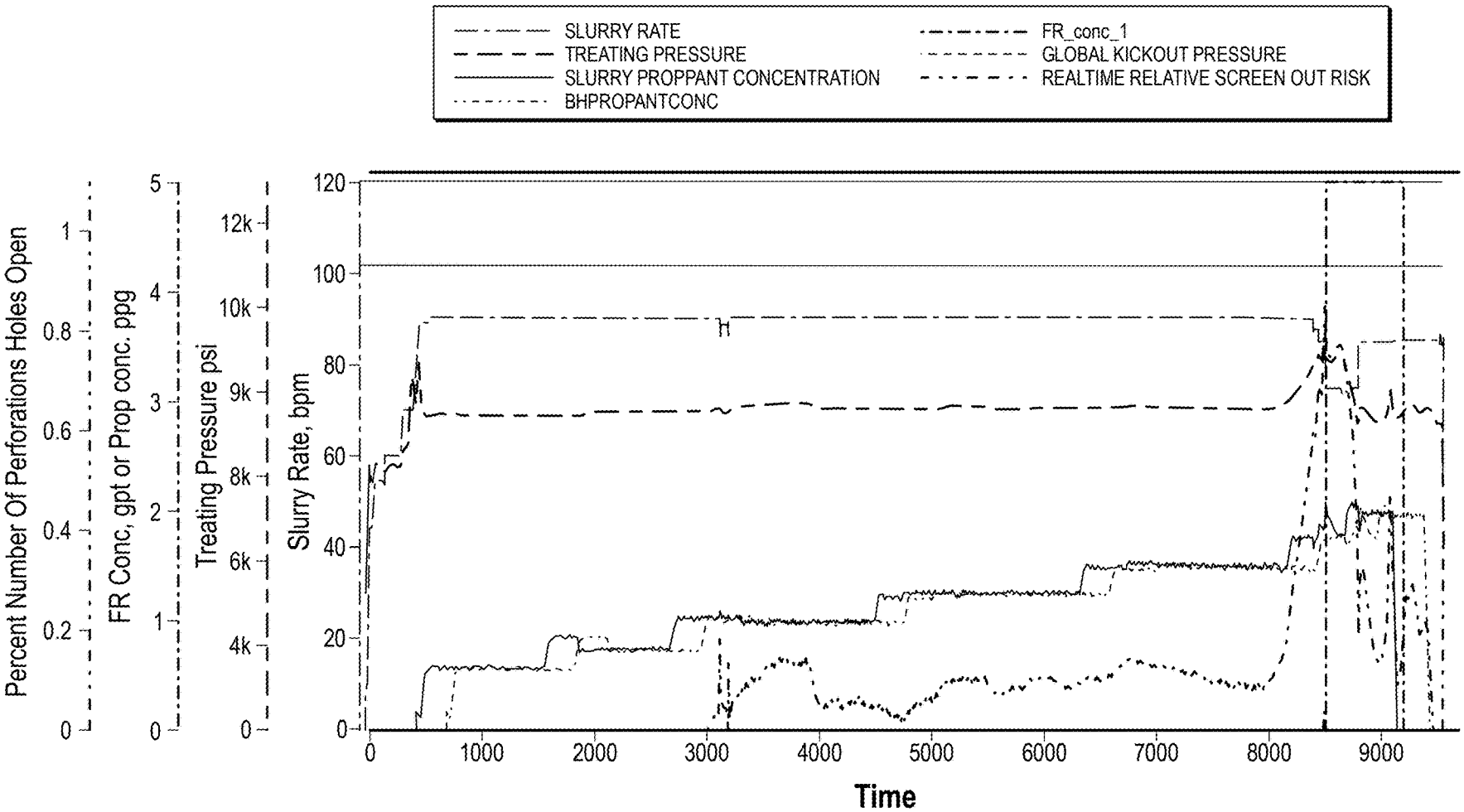
FIG. 5 illustrates an example of Realtime Screen out Risk estimation for actual treatment.

Replacing surface treating pressure $P_s$ by kickout pressure allows for threshold calculations. Further in block 324, current relative threshold number of perforation holes 108 open relative threshold $N_{,t}$ may be computed by Equation (6):

$$\text{relative threshold } N_{,t} = \frac{NThreshold_{,t}}{N_{,0}} \quad \text{Equation (6)}$$

Where $N_{Threshold,t}$ was the calculated threshold number of any timestamp holes from block 324 and $N_{,0}$ may be the initial number of perforation holes 108 defined as per fracturing operation 100 or in this case number of perforation holes 108 at least resistance. A Relative percentage threshold number of holes open at any time t i.e. Relative $N_{Threshold,t}$ can be calculated as $100*N_{Threshold,t}/N_0$ as illustrated in FIG. 5.

In block 326, the $Risk_{Relative}$ i.e. relative risk of a screen out may be estimated from Equation (9), discussed below. In examples, relative number of perforation holes 108 open at least resistance relative $N_{,0}$ may be computed in Equation (7):

$$\text{relative } N_{,0} = \frac{N_{,0}}{N_{,0}} \quad \text{Equation (7)}$$

In examples, the computed product for Equation (7) is 1. In addition, least resistance time stamp threshold number of perforation holes 108 open $N_{Threshold,0}$ may be determined in Equation (8) by using minimum slurry rate and BHP calculated using kickout pressure and frictional pressure drop at minimum slurry rate:

$$N_{Threshold,0} = \frac{(0.2369 \times \rho \times Q^2)/(BHP - P_{ref})}{Cd^2 \times D^4} \quad \text{Equation (8)}$$

Further, relative threshold number of perforation holes 108 open at least resistance i.e. relative threshold $N_{,0}$ may be determined in Equation (9):

$$\text{Relative } N_{Threshold,0} = \frac{N_{Threshold,0}}{N_{,0}} \quad \text{Equation (9)}$$

Finally, relative screen out risk $Risk_{Relative}$ may be calculated in Equation (10):

$$Risk_{Relative} = 1 - \frac{\text{Relative } N_{,t} - \text{Relative } N_{Threshold,t}}{\text{Relative } N_{,0} - \text{Relative } N_{Threshold,0}} \quad \text{Equation (10)}$$

FIG. 5 illustrates an example of Realtime Screen out Risk estimation for actual treatment. A relative risk can be described as a deviation from the least resistance situation or time point. The higher the deviation, higher is the risk of screen out. A value of $Risk_{Relative}=0$ means no screen out risk at all whereas $Risk_{Relative}=1$ means complete screen out i.e. inability to pump sand/water without exceeding kickout pressure and/or complete sand settlement in the wellbore.

Figure 3B:
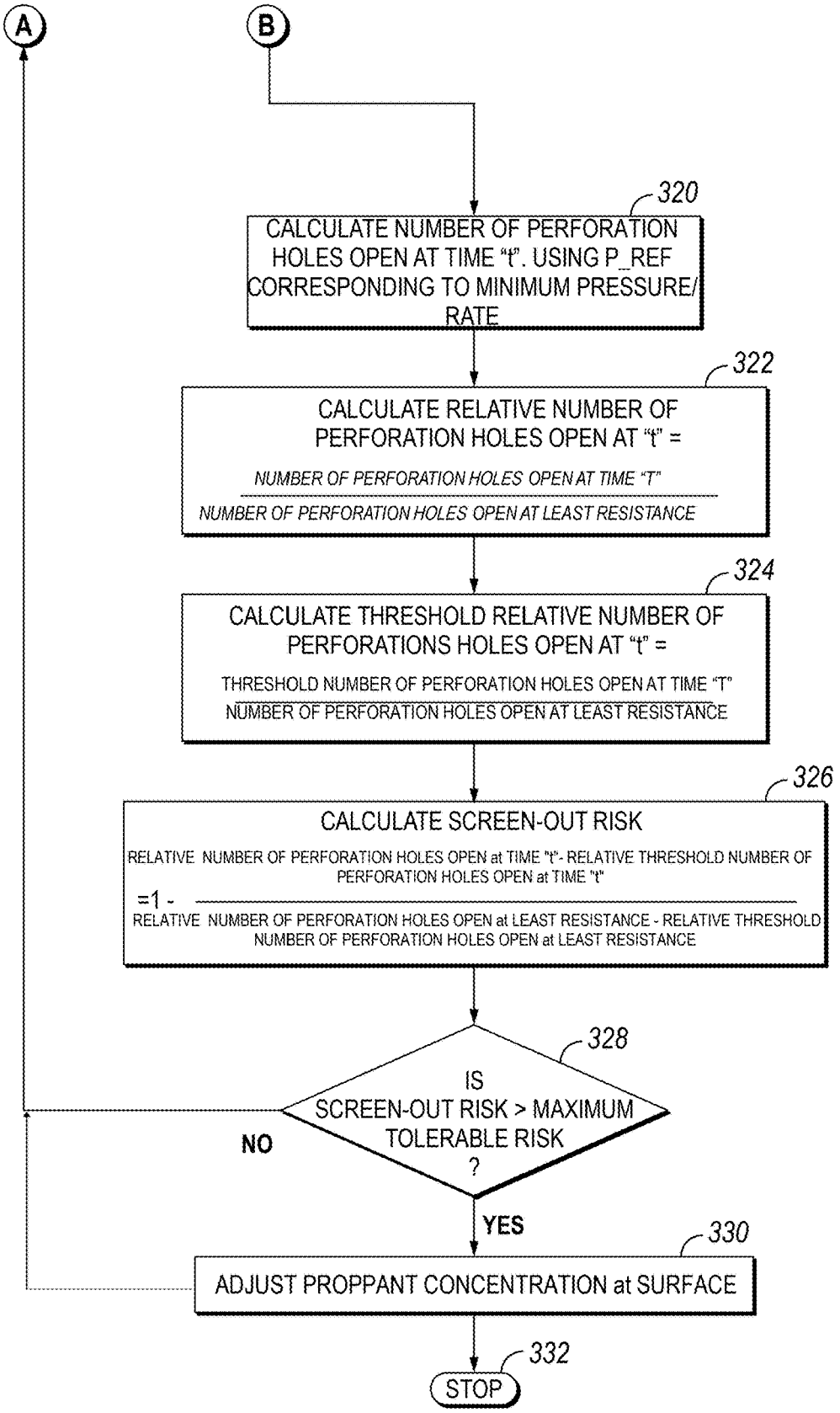
FIG. 3B is a second part of flowchart for calculating relative risk of a screen out.

Referring back to FIG. 3B, in block 328 if $Risk_{Relative}$ relative risk of a screen out>Maximum tolerable risk, then workflow 300 proceeds to block 330. Otherwise, workflow 300 proceeds back to block 304 and a new timestamp is updated. The Maximum tolerable risk may be defined by fracturing operation 100. In block 330, the proppant concentration adjusted to predefined set value useful to mitigate the screen out risk once the maximum tolerable risk is exceeded. A set value to be used may be current proppant concentration so that the proppant concentration will not go up unless the risk drops the threshold value even if the next fluid stage has higher proppant concentration as per the plan. In another example, the proppant concentration can be set to 0 value depending on the value of risk threshold to mitigate the screen out risk and flush the proppant out of wellbore into formation. In block 332, processing operations may end.

The methods and systems described above are an improvement over the current technology as the methods and systems described herein provide for relatively computing the risk of a screen out during a proppant pumping phase as well as mitigating the risk for complete screen out risk by adjusting the proppant concentration in real time.

In conventional proppant pumping phases, real-time measurements may be limited to monitoring the surface pressure and cutting off rate and/or proppant when a pressure level reaches a threshold.

Accordingly, as described herein, systems and methods for monitoring the risk of a screen out are disclosed herein. That is, in addition to providing real-time pressure measurements, relative risk of screen out may be computed and control action is executed to mitigate the risk of complete screen out by adjusting proppant concentration and/or other variables impacting surface pressure in real time. Further, such a system and method more precisely determines the risk of a screen out.

The systems and methods may comprise any of the various features disclosed herein, comprising one or more of the following statements.

Statement 1. A method comprising: acquiring one or more pumping operation measurements at a surface during a fracturing operation; calculating a least resistance condition for the fracturing operation based at least in part on the fracturing operation and the one or more pumping operation measurements; calculating a new resistance condition based at least in part on one or more pumping operation measurements and the least resistance condition; and calculating a relative screen out risk with the least resistance condition and the new resistance condition.

Statement 2. The method of statement 1, further comprising determining a bottom hole pressure, wherein the bottom hole pressure is computed by:

$$BHP=P_s+P_f+P_h$$

wherein, $P_s$, $P_f$, $P_h$ are Surface treating pressure, Frictional pressure drop and Hydrostatic pressure respectively.

Statement 3. The method of statement 2, further comprising determining a ratio of the bottom hole pressure to a flow rate.

Statement 4. The method of statement 3, wherein the least resistance condition is determined when the ratio of the bottom hole pressure to the flow rate is at its minimum.

Statement 5. The method of statement 2, further comprising determining a reference pressure at least resistance condition by:

$$P_{ref} = BHP - \left(\frac{(0.2369 \times \rho \times Q^2)}{(Cd^2 \times D^4 \times N^2)}\right)$$

wherein, $P_{ref}$ is the reference pressure inside fracture, Q is current flow rate and ρ, Cd, D, N are slurry density, discharge coefficient, perforation diameter, and N is number of perforation holes open.

Statement 6. The method of statement 5, further comprising calculating a number of perforation holes with the reference pressure and at least resistance condition, wherein with the bottom hole pressure corresponds to flow rate.

Statement 7. The method of statement 6, further comprising calculating a threshold number of perforation holes with the reference pressure and at least resistance condition, with the bottom hole pressure corresponding to kickout pressure and the flow rate.

Statement 8. The method of statement 7, further comprising calculating a number of perforation holes 108 of the new resistance condition with the reference pressure and a current pressure flow rate, wherein the current pressure flow rate is calculated with bottom hole pressure and the flow rate.

Statement 9. The method of statement 8, further comprising calculating a relative number of perforation holes open with respect to a least resistance number of perforation holes open.

Statement 10. The method of statement 9, further comprising calculating a relative threshold number of perforation holes open with respect to a least resistance threshold number of perforation holes open.

Statement 11. The method of statement 10, wherein computing the relative screen out risk utilizes:

$$\text{Risk}_{Relative} = 1 - \frac{\text{Relative } N_{,t} - \text{Relative } N_{Threshold,t}}{\text{Relative } N_{,0} - \text{Relative } N_{Threshold,0}}$$

wherein $\text{Risk}_{Relative}$ is relative screen out, Relative $N_{,t}$ is current relative number of perforation holes open, Relative $N_{Threshold,t}$ is current relative threshold number of perforation holes open, Relative $N_{,0}$ is relative number of perforation holes open at least resistance, and Relative $N_{Threshold,0}$ is relative threshold number of perforation holes at least resistance.

Statement 12. The method of statement 1, wherein the one or more pumping operation measurements comprise pressure measurements, flow rate, surface proppant concentration, bottomhole pressure, friction reducer concentration, and/or slurry density.

Statement 13. The method of statement 1, further comprising adjusting a slurry proppant concentration and other variables impacting surface pressure based on the relative screen out risk.

Statement 14. A non-transitory computer readable medium having data stored therein representing a software executable by a computer, the software executable comprising instructions configured to: acquire one or more pumping operation measurements at a surface during a fracturing operation; calculate a least resistance condition for the fracturing operation based at least in part on the fracturing operation and the one or more pumping operation measurements; calculate a new resistance condition based at least in part on one or more pumping operation measurements and the least resistance condition; and calculate a relative screen out risk with the least resistance condition and the new resistance condition.

Statement 15. The non-transitory computer readable medium of statement 14, wherein the instructions are further configured to determine a bottom hole pressure, wherein the bottom hole pressure is computed by:

$$BHP=P_s+P_f+P_h$$

wherein, $P_s$, $P_f$, $P_h$ are Surface treating pressure, Frictional pressure drop and Hydrostatic pressure respectively and determine a ratio of the bottom hole pressure to a flow rate.

Statement 16. The non-transitory computer readable medium of statement 15, wherein the least resistance condition is determined when the ratio of the bottom hole pressure to the flow rate is at its minimum.

Statement 17. The non-transitory computer readable medium of statement 16, wherein the instructions are further configured to determine a reference pressure at least resistance condition by:

$$P_{ref} = BHP - \left(\frac{(0.2369 \times \rho \times Q^2)}{(Cd^2 \times D^4 \times N^2)}\right)$$

wherein, $P_{ref}$ is the reference pressure inside fracture, Q is current flow rate and ρ, Cd, D, N are slurry density, discharge coefficient, perforation diameter, and N is number of perforation holes open.

Statement 18. The non-transitory computer readable medium of statement 17, wherein the instructions are further configured to calculate a number of perforation holes with the reference pressure and at least resistance condition, wherein with the bottom hole pressure corresponds to flow rate.

Statement 19. The non-transitory computer readable medium of statement 18, wherein the instructions are further configured to calculate a threshold number of perforation holes with the reference pressure and at least resistance condition, with the bottom hole pressure corresponding to kickout pressure and the flow rate.

Statement 20. The non-transitory computer readable medium of statement 19, wherein the instructions are further configured to calculate a number of perforation holes of the new resistance condition with the reference pressure and a current pressure flow rate, wherein the current pressure flow rate is calculated with bottom hole pressure and current flow rate, a relative number of perforation holes open with respect to a least resistance number of perforation holes open, and a relative threshold number of perforation holes open with respect to a least resistance threshold number of perforation holes open.

As it is impracticable to disclose every conceivable embodiment of the technology described herein, the figures, examples, and description provided herein disclose only a limited number of potential embodiments. A person of ordinary skill in the art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to people of ordinary skill in the art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment-which may be implemented in addition to, in conjunction with, or in place of an embodiment of a similarly-named component described for any other figure.

As used herein, adjective ordinal numbers (e.g., first, second, third, etc.) are used to distinguish between elements and do not create any particular ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, the word "data" may be used as an "uncountable" singular noun—not as the plural form of the singular noun "datum". Accordingly, throughout the application, "data" is generally paired with a singular verb (e.g., "the data is modified"). However, "data" is not redefined to mean a single bit of digital information. Rather, as used herein, "data" means any one or more bit(s) of digital information that are grouped together (physically or logically). Further, "data" may be used as a plural noun if context provides the existence of multiple "data" (e.g., "the two data are combined").

As used herein, the term "operative connection" (or "operatively connected") means the direct or indirect connection between devices that allows for interaction in some way (e.g., via the exchange of information). For example, the phrase 'operatively connected' may refer to a direct connection (e.g., a direct wired or wireless connection between devices) or an indirect connection (e.g., multiple wired and/or wireless connections between any number of other devices connecting the operatively connected devices).

As used herein, indefinite articles "a" and "an" mean "one or more". That is, the explicit recitation of "an" element does not preclude the existence of a second element, a third element, etc. Further, definite articles (e.g., "the", "said") mean "any one of" (the "one or more" elements) when referring to previously introduced element(s). As an example, there may exist "a processor", where such a recitation does not preclude the existence of any number of other processors. Further, "the processor receives data, and the processor processes data" means "any one of the one or more processors receives data" and "any one of the one or more processors processes data". It is not required that the same processor both (i) receive data and (ii) process data. Rather, each of the steps ("receive" and "process") may be performed by different processors.

What is claimed is:

1. A method comprising: acquiring one or more pumping operation measurements utilizing at least a pump controller at a surface during a fracturing operation; calculating a least resistance condition for the fracturing operation based at least in part on the fracturing operation and the one or more pumping operation measurements; calculating a new resistance condition based at least in part on one or more pumping operation measurements and the least resistance condition; and calculating a relative screen out risk with the least resistance condition and the new resistance condition.

2. The method of claim 1, further comprising determining a bottom hole pressure, wherein the bottom hole pressure is computed by:

$$BHP=P_s+P_f+P_h$$

wherein, $P_s$, $P_f$, $P_h$ are Surface treating pressure, Frictional pressure drop and Hydrostatic pressure respectively.

3. The method of claim 2, further comprising determining a ratio of the bottom hole pressure to a flow rate.

4. The method of claim 3, wherein the least resistance condition is determined when the ratio of the bottom hole pressure to the flow rate is at its minimum.

5. The method of claim 2, further comprising determining a reference pressure at least resistance condition by:

$$P_{ref} = BHP - \left(\frac{(0.2369 \times \rho \times Q^2)}{(Cd^2 \times D^4 \times N^2)}\right)$$

wherein, $P_{ref}$ is the reference pressure inside fracture, Q is current flow rate and ρ, Cd, D, N are slurry density, discharge coefficient, perforation diameter, and N is number of perforation holes open.

6. The method of claim 5, further comprising calculating a number of perforation holes with the reference pressure and at least resistance condition, wherein with the bottom hole pressure corresponds to flow rate.

7. The method of claim 6, further comprising calculating a threshold number of perforation holes with the reference pressure and at least resistance condition, with the bottom hole pressure corresponding to kickout pressure and the flow rate.

8. The method of claim 7, further comprising calculating a number of perforation holes 108 of the new resistance condition with the reference pressure and a current pressure flow rate, wherein the current pressure flow rate is calculated with bottom hole pressure and the flow rate.

9. The method of claim 8, further comprising calculating a relative number of perforation holes open with respect to a least resistance number of perforation holes open.

10. The method of claim 9, further comprising calculating a relative threshold number of perforation holes open with respect to a least resistance threshold number of perforation holes open.

11. The method of claim 10, wherein computing the relative screen out risk utilizes:

$$\text{Risk}_{Relative} = 1 - \frac{\text{Relative } N_{,t} - \text{Relative } N_{Threshold,t}}{\text{Relative } N_{,0} - \text{Relative } N_{Threshold,0}}$$

wherein $\text{Risk}_{Relative}$ is relative screen out, Relative $N_{,t}$ is current relative number of perforation holes open, Relative $N_{Threshold,t}$ is current relative threshold number of perforation holes open, Relative $N_{,0}$ is relative number of perforation holes open at least resistance, and Relative $N_{Threshold,0}$ is relative threshold number of perforation holes at least resistance.

12. The method of claim 1, wherein the one or more pumping operation measurements comprise pressure measurements, flow rate, surface proppant concentration, bottomhole pressure, friction reducer concentration, and/or slurry density.

13. The method of claim 1, further comprising adjusting a slurry proppant concentration and other variables impacting surface pressure based on the relative screen out risk.

14. A non-transitory computer readable medium having data stored therein representing a software executable by a computer, the software executable comprising instructions configured to: acquire one or more pumping operation measurements utilizing at least a pump controller at a surface during a fracturing operation; calculate a least resistance condition for the fracturing operation based at least in part on the fracturing operation and the one or more pumping operation measurements; calculate a new resistance condition based at least in part on one or more pumping operation measurements and the least resistance condition; and calculate a relative screen out risk with the least resistance condition and the new resistance condition.

15. The non-transitory computer readable medium of claim 14, wherein the instructions are further configured to determine a bottom hole pressure, wherein the bottom hole pressure is computed by:

$$BHP = P_s + P_f + P_h$$

wherein, $P_s$, $P_f$, $P_h$ are Surface treating pressure, Frictional pressure drop and Hydrostatic pressure respectively and determine a ratio of the bottom hole pressure to a flow rate.

16. The non-transitory computer readable medium of claim 15, wherein the least resistance condition is determined when the ratio of the bottom hole pressure to the flow rate is at its minimum.

17. The non-transitory computer readable medium of claim 16, wherein the instructions are further configured to determine a reference pressure at least resistance condition by:

$$P_{ref} = BHP - \left(\frac{(0.2369 \times \rho \times Q^2)}{(Cd^2 \times D^4 \times N^2)}\right)$$

wherein, $P_{ref}$ is the reference pressure inside fracture, Q is current flow rate and ρ, Cd, D, N are slurry density, discharge coefficient, perforation diameter, and N is number of perforation holes open.

18. The non-transitory computer readable medium of claim 17, wherein the instructions are further configured to calculate a number of perforation holes with the reference pressure and at least resistance condition, wherein with the bottom hole pressure corresponds to flow rate.

19. The non-transitory computer readable medium of claim 18, wherein the instructions are further configured to calculate a threshold number of perforation holes with the reference pressure and at least resistance condition, with the bottom hole pressure corresponding to kickout pressure and the flow rate.

20. The non-transitory computer readable medium of claim 19, wherein the instructions are further configured to calculate a number of perforation holes of the new resistance condition with the reference pressure and a current pressure flow rate, wherein the current pressure flow rate is calculated with bottom hole pressure and current flow rate, a relative number of perforation holes open with respect to a least resistance number of perforation holes open, and a relative threshold number of perforation holes open with respect to a least resistance threshold number of perforation holes open.

* * * * *